US011628492B2

(12) United States Patent
Yoo

(10) Patent No.: US 11,628,492 B2
(45) Date of Patent: Apr. 18, 2023

(54) CORE FOR HOLLOW PRODUCT MANUFACTURE INCLUDING MULTILAYER FILLING MATERIAL AND METHOD OF MANUFACTURING HOLLOW PRODUCT USING THE CORE

(71) Applicant: MH TECHNOLOGIES INC., Incheon (KR)

(72) Inventor: Jin-Ho Yoo, Seoul (KR)

(73) Assignee: MH TECHNOLOGIES INC., Incheon (KR)

( * ) Notice: Subject to any disclaimer, the term of this patent is extended or adjusted under 35 U.S.C. 154(b) by 175 days.

(21) Appl. No.: 16/951,386

(22) Filed: Nov. 18, 2020

(65) Prior Publication Data

US 2021/0146583 A1 May 20, 2021

(30) Foreign Application Priority Data

Nov. 19, 2019 (KR) ..... 10-2019-0148402

(51) Int. Cl.

| | |
|---|---|
| ***B22D 29/00*** | (2006.01) |
| ***B22C 9/10*** | (2006.01) |
| ***B22D 19/00*** | (2006.01) |

(52) U.S. Cl.

CPC ..... *B22D 29/003* (2013.01); *B22C 9/103* (2013.01); *B22D 19/0072* (2013.01); *B22D 29/002* (2013.01)

(58) Field of Classification Search

CPC ..... B22D 29/001–003; B22D 19/0072; B22C 9/10; B22C 9/103; B22C 9/106

See application file for complete search history.

(56) References Cited

U.S. PATENT DOCUMENTS

2017/0173678 A1* 6/2017 Wu ..... B22C 9/04

FOREIGN PATENT DOCUMENTS

| | | |
|---|---|---|
| EP | 0 110 234 A1 | 6/1984 |
| EP | 0 550 583 B1 | 12/1994 |

(Continued)

OTHER PUBLICATIONS

Machine Translation of Choi (KR 10-2017-0128817, published Nov. 24, 2017, cited in IDS filed Nov. 18, 2020). (Year: 2017).*

(Continued)

*Primary Examiner* — Kevin E Yoon
*Assistant Examiner* — Jacky Yuen
(74) *Attorney, Agent, or Firm* — Birch, Stewart, Kolasch & Birch, LLP

(57) ABSTRACT

The present invention relates to a core for hollow product manufacture including a multilayer filling material, which may be used in forming a cooling water circulation channel through which a fluid such as cooling water may pass, and a method of manufacturing a hollow product using the core, and the core includes a pipe, having a hollow formed in the pipe and an opening formed at both ends of the pipe so that the hollow is exposed to the outside through the opening, a first support member, being disposed inside the hollow and having a space formed in the first support member, a second support member, being disposed in the space, and a melting bar, passing through the second support member in a longitudinal direction of the melting bar, wherein the melting bar melts and forms a space in the second support member when the melting bar is heated.

4 Claims, 5 Drawing Sheets

(56) References Cited

FOREIGN PATENT DOCUMENTS

| | | | | | |
|---|---|---|---|---|---|
| GB | 1209382 | A | * | 10/1970 | ..... B22C 9/106 |
| JP | 5737016 | B2 | | 6/2015 | |
| KR | 10-2014-0022094 | A | | 2/2014 | |
| KR | 10-2017-0118309 | A | | 10/2017 | |
| KR | 10-2017-0128817 | A | | 11/2017 | |
| WO | WO 2017/179962 | A1 | | 10/2017 | |

OTHER PUBLICATIONS

The Extended European Search Report dated Mar. 10, 2021 for Application No. 20207682.4 is attached.

* cited by examiner

[Fig.1]
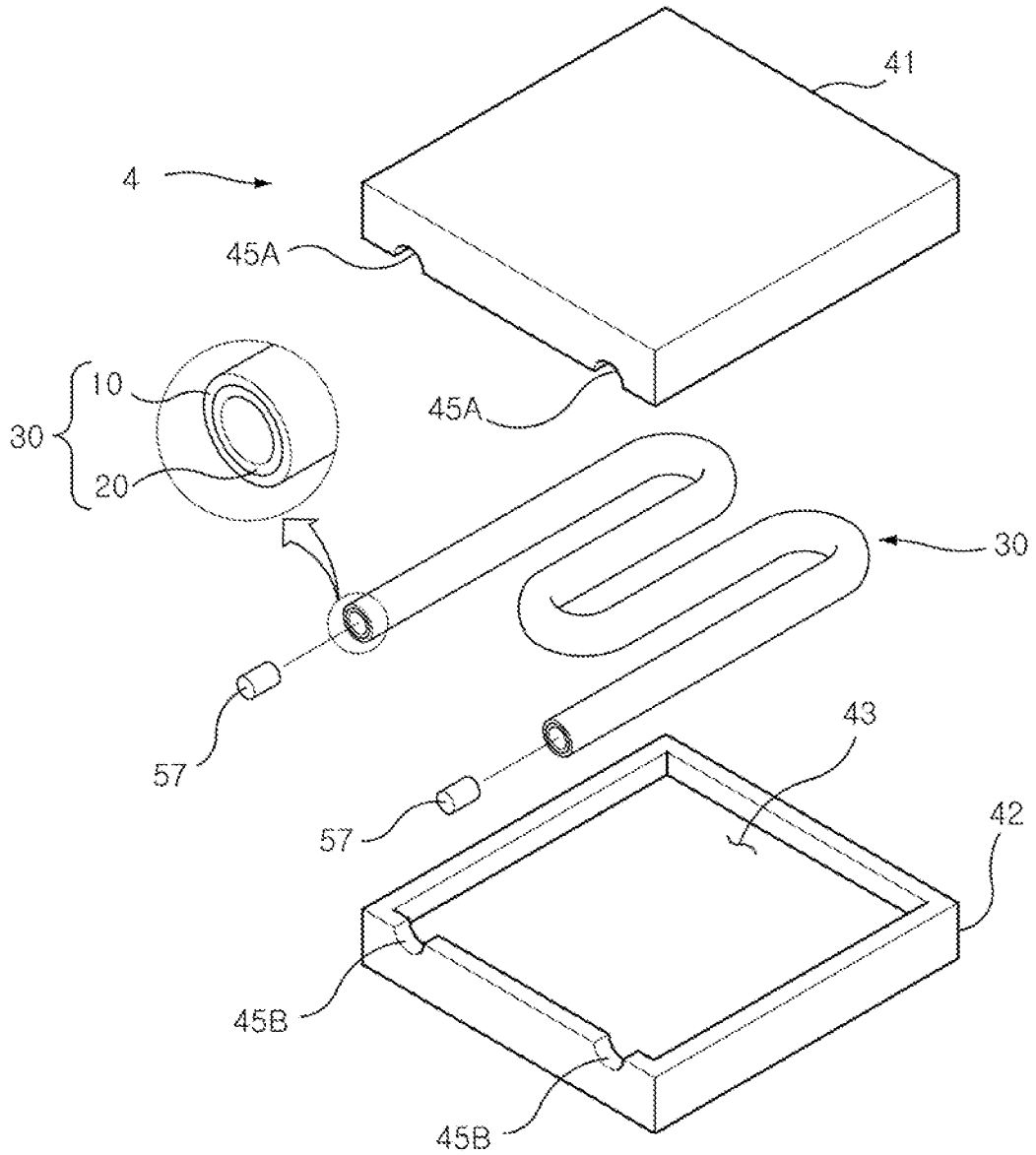

[Fig.2]
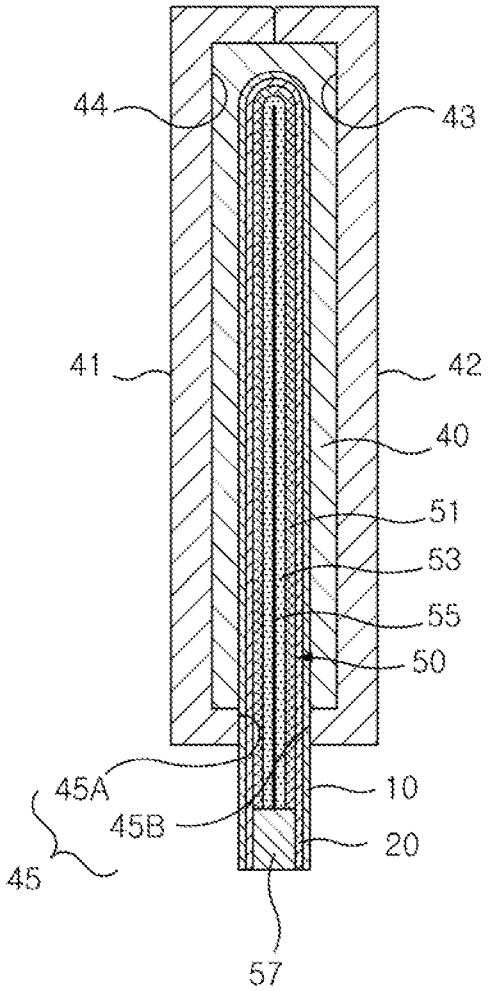

[Fig.3]
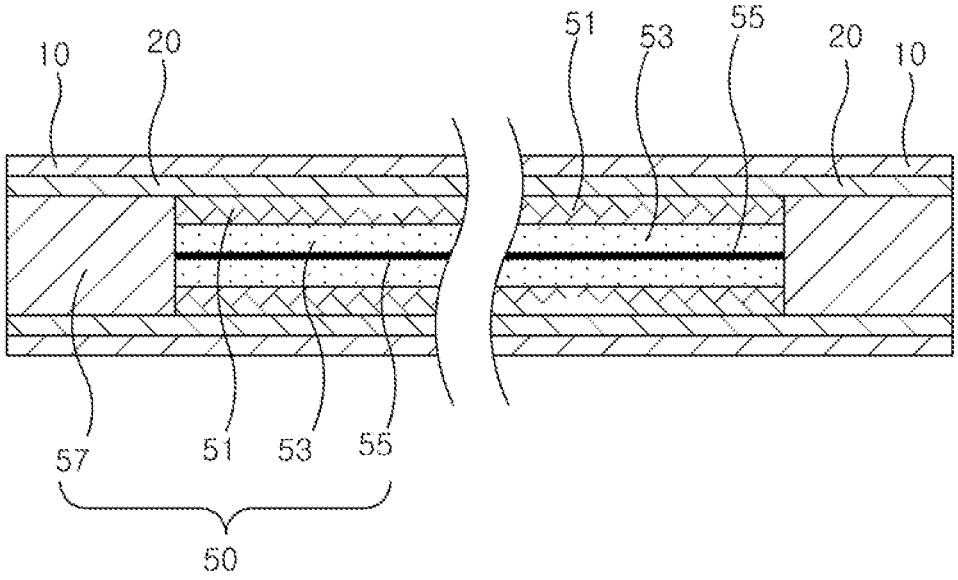
[Fig.4]
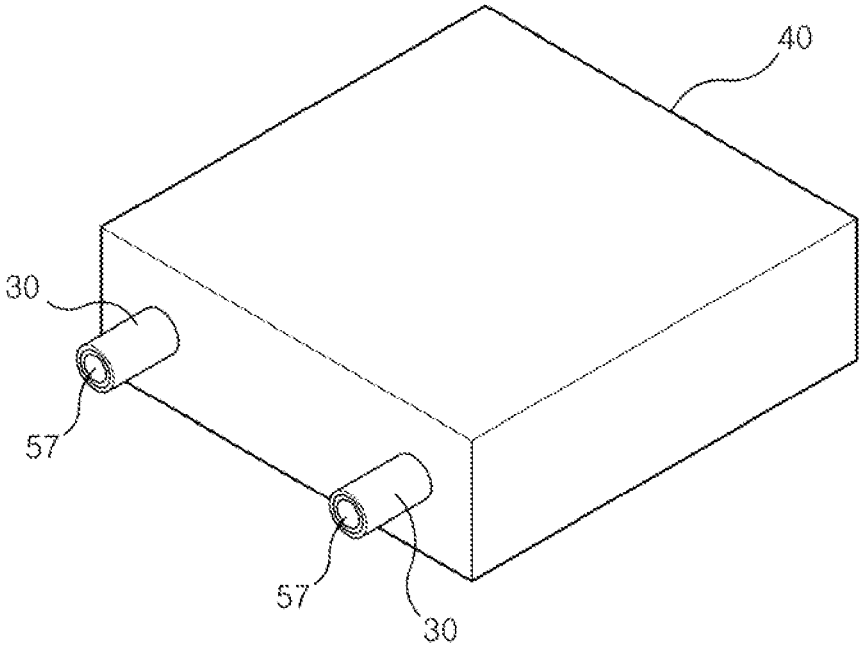

[Fig.5]
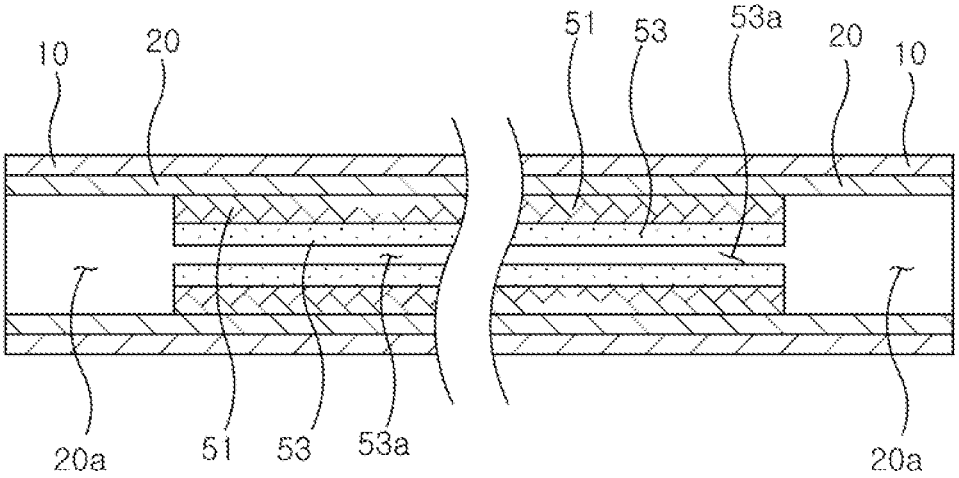

[Fig.6]
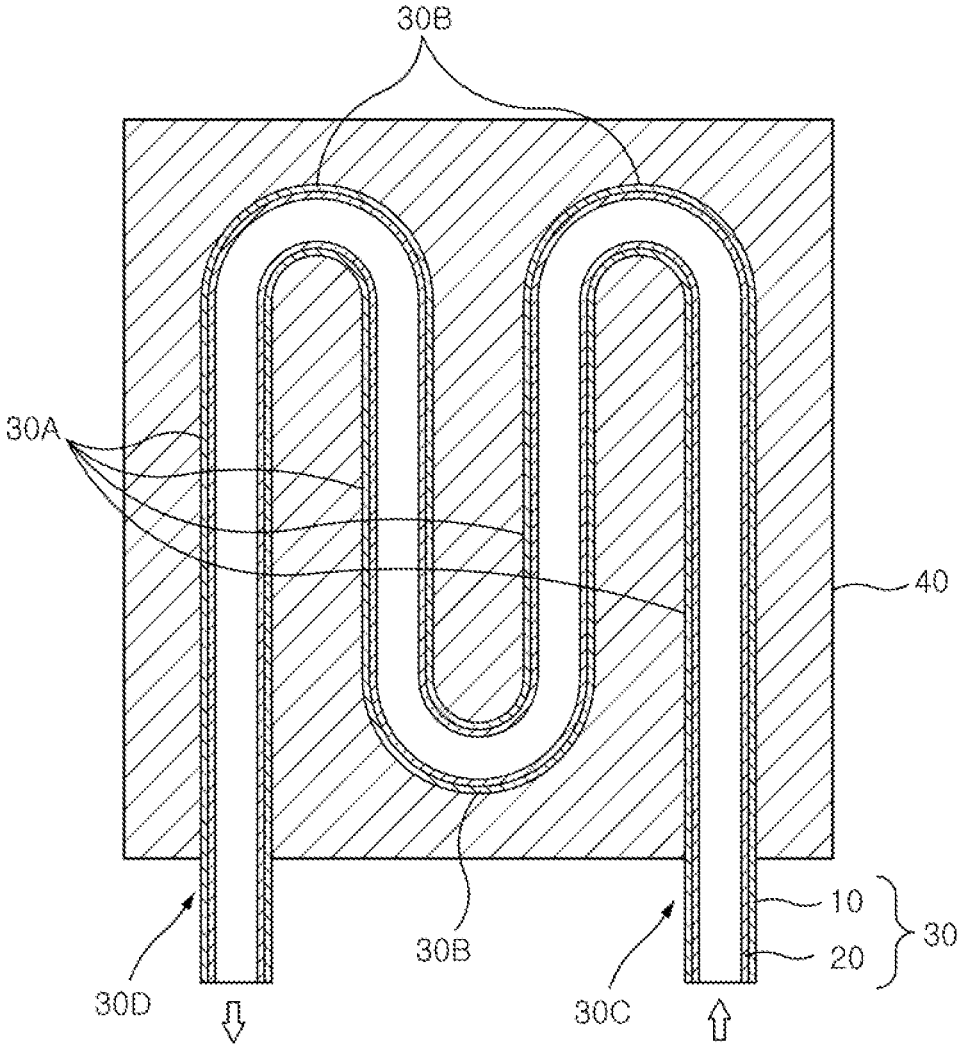

CORE FOR HOLLOW PRODUCT MANUFACTURE INCLUDING MULTILAYER FILLING MATERIAL AND METHOD OF MANUFACTURING HOLLOW PRODUCT USING THE CORE

CROSS REFERENCE TO RELATED APPLICATIONS

This non-provisional application claims the benefit under 35 U.S.C. § 119(a) to Patent Application No. 10-2019-0148402, filed in the Republic of Korea on Nov. 19, 2019, all of which are hereby expressly incorporated by reference into the present application.

BACKGROUND

1. Technical Field

The present invention relates to a core for hollow product manufacture including a multilayer filling material and a method of manufacturing a hollow product using the core, and more particularly, to a core for hollow product manufacture including a multilayer filling material, which may be used in forming a cooling water circulation channel through which a fluid such as cooling water may pass, and a method of manufacturing a hollow product using the core.

2. Description of Related Art

Generally, in order to mold a hollow product by casting, a core made of a single material, such as a sand core or a salt core, is used as in Japanese Patent Registration No. JP5737016. A core is a component inserted into a mold to form the shape of a cast product, i.e., a molded product, and generally, sand, a thermosetting resin, or salt has been used as the core. The core is utilized as a core to perform casting, and then the core is removed from a molded product so that the molded product has a hollow formed therein.

Conventionally, in order to remove a core, a method has been used in which, after casting, an impact is applied to a molded product to break the core, such as a sand core or a salt core, and then water or air is strongly injected into the hollow to wash out the broken pieces of the core. However, according to the shape of the core, such as a bent portion or a spiral structure, there are some areas in the core that are not broken. That is, there is a problem in that, after casting and molding, due to bonding between cast products, it is not easy for the sand, thermosetting resin, or salt used as the core to be eluted from the cast product.

The areas of the core that are not broken aggregate into lumps and block some sections of the hollow, thus obstructing the flow of air or water. Consequently, the core is not removed from the hollow.

Also, in the case of the sand core, a problem occurs in that sand particles are stuck on and not removed from a casting surface. Since the residue may later cause a failure of a system, it is very important to completely remove the core.

In order to address the above-mentioned problems, recently, a pipe having a hollow formed therein has been used as a core. In relation thereto, a method of manufacturing a hollow product has been disclosed in Korean Patent Laid-Open Publication No. 10-2017-0118309. However, when manufacturing the hollow product, there are problems in that a pipe melts and is damaged by a high temperature of a melting solution, that is, a melt, and an injection pressure causes a support member to generate indentations on an inner wall of the pipe.

SUMMARY

1. Technical Problem

An embodiment of the present invention provides a core for hollow product manufacture including a multilayer filling material and a method of manufacturing a hollow product using the core that allows the prevention of a case where a pipe is damaged by a high temperature of a melting solution during casting.

Also, an embodiment of the present invention provides a core for hollow product manufacture including a multilayer filling material and a method of manufacturing a hollow product using the core that allow the prevention of a case where an injection pressure of a melting solution causes a support member, which is filled in a pipe, to generate indentations on an inner wall of the pipe.

Also, an embodiment of the present invention provides a core for hollow product manufacture including a multilayer filling material and a method of manufacturing a hollow product using the core in which a portion of an outer layer of a pipe melts due to a high temperature of a melting solution and then is cooled so that a bonding force between the cooled melting material and the pipe is high.

Also, an embodiment of the present invention provides a core for hollow product manufacture including a multilayer filling material and a method of manufacturing a hollow product using the core in which it is easy to remove a support member filled in a pipe.

2. Solution to Problem

The present invention provides a core for hollow product manufacture including a multilayer filling material, the core including a pipe, having a hollow formed in the pipe and an opening formed at both ends of the pipe so that the hollow is exposed to the outside through the opening, a first support member, being disposed inside the hollow and having a space formed in the first support member, a second support member, being disposed in the space, and a melting bar, passing through the second support member in a longitudinal direction of the melting bar, wherein the melting bar melts and forms a space in the second support member when the melting bar is heated.

The first support member may be made of a water-soluble material, and the second support member may be made of a water-insoluble material.

The core may further include a third support member, being disposed in the hollow of the pipe to close both ends of the pipe to prevent the first support member and the second support member from flowing to the outside.

The pipe may include a first pipe and a second pipe, being disposed inside the first pipe and having a melting point higher than a melting point of the first pipe.

The second pipe may have a melting point higher than the melting point of the first pipe.

The second pipe may have a hardness equal to a hardness of the first support member or higher than the hardness of the first support member so that, when an external pressure is applied to an outer circumferential surface of the second pipe, an indentation thereon due to the first support member is prevented.

The first support member may include salt, and the second support member may include one of a ceramic, sand, and metal balls.

Also, the present invention provides a method of manufacturing a hollow product using a core, the method including a core input step in which a core filled with a filling material is input into a cavity of a mold that is openable and closeable, a molding step in which a melt is injected into the cavity to surround the core so that a molded product is molded, and a filling material removing step in which the filling material is removed from the core embedded in the molded product, wherein the filling material includes a support member being configured to support the core and a melting bar passing through the support member in a longitudinal direction of the melting bar, and the filling material removing step includes heating the molded product so that the melting bar melts and forms a space portion in the support member.

The support member may include a first support member, being disposed inside the hollow and having a space formed in the first support member, and a second support member, being disposed in the space, and the melting bar may pass through the second support member in a longitudinal direction of the second support member.

The first support member may be made of a water-soluble material, and the second support member may be made of a water-insoluble material.

3. Advantageous Effects

According to an embodiment of the present invention, there are the following effects.

First, according to an embodiment of the present invention, there is an effect of preventing a case where a pipe is damaged by a high temperature of a melting solution during casting.

Second, according to an embodiment of the present invention, there is an effect of preventing a case where an injection pressure of a melting solution causes a support member, which is filled in a pipe, to generate an indentation on an inner wall of the pipe.

Third, according to an embodiment of the present invention, there is an effect that a portion of an outer layer of a pipe melts due to a high temperature of a melting solution and then is cooled so that a bonding force between the cooled melting material and the pipe is high.

Fourth, according to an embodiment of the present invention, there is an effect of allowing easy removal of a support member filled in a pipe.

BRIEF DESCRIPTION OF DRAWINGS

FIG. 1 is an exploded perspective view of a mold device for manufacturing a hollow molded product according to an embodiment of the present invention;

FIG. 2 is a side cross-sectional view illustrating a state in which a molded product is disposed in the mold device for manufacturing a hollow molded product that is illustrated in FIG. 1;

FIG. 3 is a cross-sectional view illustrating a state in which a support member is filled in a pipe illustrated in FIG. 1;

FIG. 4 illustrates a molded product having a hollow formed therein that is manufactured using the mold device for manufacturing a hollow molded product, which is illustrated in FIG. 1;

FIG. 5 is a cross-sectional view illustrating a state in which a third support member and a melting bar are removed from the pipe having the support member filled therein that is illustrated in FIG. 3; and FIG. 6 is a cross-sectional view of the molded product having the hollow formed therein, which is illustrated in FIG. 4, and illustrates a state in which the support member is removed from the hollow.

DETAILED DESCRIPTION OF EMBODIMENTS

The embodiments described below are illustratively shown to aid understanding of the invention, and it should be understood that the present invention may be modified and embodied in various ways, differently from the embodiments described herein. However, in describing the present invention, when it is determined that detailed description of a related known function or element may unnecessarily obscure the gist of the present invention, the detailed description and detailed illustration thereof will be omitted. In addition, to aid understanding of the invention, the accompanying drawings may have not been drawn to scale, and dimensions of some elements may have been exaggerated.

Terms such as first and second used herein may be used to describe various elements, but the elements should not be limited by the terms. The terms are only used for the purpose of distinguishing one element from another element.

Also, the terms used herein are only used to describe specific embodiments and are not intended to limit the scope of the present invention. A singular expression includes a plural expression unless the context clearly indicates otherwise. In the application, terms such as "include," "have," or "consist of" should be understood as specifying that features, numbers, steps, operations, elements, components, or combinations thereof are present and not as precluding the possibility of the presence or addition of one or more other features, numbers, steps, operations, elements, components, or combinations thereof in advance.

Hereinafter, a core for hollow product manufacture including a multilayer filling material and a method of manufacturing a hollow product using the core according to an embodiment of the present invention will be described with reference to FIGS. 1 and 2. FIG. 1 is an exploded perspective view of a mold device for manufacturing a hollow molded product according to an embodiment of the present invention, and FIG. 2 is a side cross-sectional view illustrating a state in which a molded product is disposed in the mold device for manufacturing a hollow molded product that is illustrated in FIG. 1.

The hollow molded product described below includes a molded product having a hollow formed therein by use of a mold device using a pipe having a double structure made of bimetal. Also, the pipe having a double structure made of bimetal may be used in the mold device for manufacturing a hollow molded product, and a method of manufacturing the hollow molded product is a method of manufacturing a molded product having a hollow formed therein that is performed using the mold device.

The mold device according to an embodiment of the present invention is a device for manufacturing a molded product having a hollow formed therein. The hollow molded product, which is the molded product having a hollow formed therein, is manufactured by opening a mold of the mold device, inputting a hollow pipe into a cavity formed inside the mold, closing the mold, and then injecting a melt. The hollow formed inside the molded product is formed as the melt injected into the cavity is cooled without being injected into a hollow inside a pipe portion 30.

The mold device includes a mold 4 including a first mold 41 and a second mold 42, and the pipe portion 30 disposed between the first mold 41 and the second mold 42.

The first mold 41 has a first cavity 44 formed therein and a first through-hole 45A disposed at one side to allow the pipe portion 30 to be fitted therein. The first through-hole 45A allows the first cavity 44 to communicate with the outside.

The second mold 42 has a second cavity 43 formed therein, and the second cavity 43 forms a single cavity together with the first cavity 44 when the second mold 42 and the first mold 41 are closed. The second mold 42 has a second through-hole 45B disposed at one side to allow the pipe portion 30 to be fitted therein. The second through-hole 45B allows the second cavity 43 to communicate with the outside. Also, the second through-hole 45B forms a single through-hole 45, in which the pipe portion 30 is disposed, together with the first through-hole 45A.

Both end portions of the pipe portion 30 are disposed outside the cavity, and at each end portion, a hole is formed to allow the hollow of the pipe portion 30 to communicate with the outside. A hole disposed at one of the both end portions may serve as an inlet through which a fluid or a support member, which will be described below, is introduced, and the hole disposed at the other end portion may serve as an outlet through which the fluid or support member is discharged.

Also, as illustrated in FIGS. 1 and 6, the pipe portion 30 includes parallel portions 30A disposed inside the cavity to be parallel to each other, bent portions 30B configured to allow the parallel portions 30A to communicate with each other, and outer protrusions 30C and 30D. The parallel portions 30A and bent portions 30B are portions embedded in the molded product.

The parallel portions 30A and bent portions 30B form a single path and communicate with the outside through the holes formed at both end portions of the pipe portion 30. Accordingly, the pipe portion 30 forms a path that continues in a zigzag manner. However, the pipe portion 30 is not limited to having a zigzag shape and may have various other shapes such as a straight shape.

The pipe portion 30 has a double structure made of bimetal and includes a first pipe 10 which forms an outer layer of the double structure and a second pipe 20 which forms an inner layer of the double structure and is disposed inside the first pipe 10. An inner circumferential surface of the first pipe 10 and an outer circumferential surface of the second pipe 20 are joined.

The first pipe 10 may be made of, for example, an aluminum (Al) material. A melting material used for a melting solution, that is, a melt, injected into the cavity may be the same material as the material of which the first pipe 10 is made. For example, the melting material may be Al or an Al alloy. Therefore, when a high-temperature melt is injected, the first pipe 10 may melt partially or entirely. In this case, a thickness of the first pipe 10 may be preset so that only a portion of an outer side of the first pipe 10 melts, instead of the entire first pipe 10 melting, due to injection of the melt.

In order to prevent indentations due to a filling material 50, which will be described below, the second pipe 20 has a hardness higher than or equal to a hardness of the filling material 50. Generally, an indentation is generated when, in a case in which a high-temperature melt is injected into a cavity, the high temperature causes a pipe to have softness, and simultaneously, an injection pressure due to the melt is applied to the pipe and an inner circumferential surface of the pipe presses a support member inside the pipe.

The second pipe 20 may be made of a material of which a melting point and hardness are higher than a melting point and hardness of each of the material of the first pipe 10 and the melting material of the melt. In this case, the first pipe 10 is made of a material having a hardness lower than or equal to the hardness of the filling material 50. Many of the materials with high hardness and melting points are expensive, and many of the materials with low hardness and melting points are cheap. When the first pipe 10 is made of a material which is the same as the melting material but has a low melting point and low hardness and thus is relatively cheap, and the second pipe 20 is made of a material which is relatively expensive and has relatively higher melting point and hardness, it is possible to obtain the pipe portion 30 having a desired performance while manufacturing costs are lowered.

The second pipe 20 may be made of, for example, a copper (Cu) material. Since the melting point of Cu is higher than that of Al, the second pipe 20 is not damaged even when the melt, of which the melting material is Al, is injected. In the case in which the second pipe 20 is made of the Cu material, the hardness of the second pipe 20 is higher than the hardness of the filling material 50. Therefore, in a state in which an inner circumferential surface of the second pipe 20 and the filling material 50 are pressed against each other, an indentation on the inner circumferential surface of the second pipe 20 by an external pressure is prevented.

Here, the external pressure refers to an injection pressure applied to an outer portion of the pipe portion 30 when the melt is injected. When the melt injection pressure is applied to an outer circumferential surface of the first pipe 10, the first pipe 10 and the second pipe 20 are slightly compressed, and the inner circumferential surface of the second pipe 20 presses the filling material 50. Since the hardness of the second pipe 20 is higher than the hardness of the filling material 50 as described above, an indentation is not generated on the inner circumferential surface of the second pipe 20.

Further, since the second pipe 20 does not come in direct contact with the melt, the degree of softening of the second pipe 20 due to the high-temperature melt is low, which is advantageous in terms of preventing indentations. This is because the second pipe 20, which is surrounded by the first pipe 10 coming in direct contact with the high-temperature melt, is heated to a lower temperature than the first pipe 10 and may maintain its original hardness to a considerable level.

The pipe portion 30 may be formed by, for example, extrusion or casting. Also, the pipe portion is bendable to a desired shape while a filling material, which will be described below, is filled therein. The pipe portion may be formed so that the minimum radius of curvature of a bent portion is 1.5 times an outer diameter of the pipe portion. The first pipe and the second pipe may be formed to have an elongation of 50% or higher. The second pipe may be made of a material that melts at a temperature higher than 700° C.

Further, the first pipe and the second pipe may bond to each other due to intermetallic bonding. The intermetallic bonding or metallic bonding is bonding between metal cations and free electrons, and the bonding force is high because the free electrons may freely move between the metal cations even when a force is applied thereto from the outside. This is possible because the bond is not broken.

Further, an intermetallic compound may be formed between the first pipe and the second pipe. The intermetallic compound refers to a case where, as two or more metals combine and strongly bond to each other, the metals are mixed in alloys and are present between crystal grains such that an intermediate phase having a heterogeneous structure is formed.

Meanwhile, when the melt is injected into the cavity, deformation of the pipe portion 30 may occur due to the pressure of the melt. Therefore, the filling material 50 is filled inside the pipe portion 30 to prevent deformation of the pipe portion 30 by the pressure of the melt.

The filling material 50 includes support members 51, 53, and 57 being configured to support the pipe portion 30 and a melting bar 55 passing through the support members 51, 53, and 57 in a longitudinal direction of the melting bar 55.

The support members 51, 53, and 57 are disposed in the hollow formed inside the pipe portion 30 and include a first support member 51, having a space formed in the first support member 51, a second support member 53, being disposed in the space of the first support member 51, and a third support member 57, being disposed in the hollow of the pipe portion 30 to close both ends of the pipe portion 30 to prevent the first support member 51 and the second support member 53 from flowing to the outside.

The first support member 51 includes a water-soluble material and prevents direct contact of the second support member 53 with an inner side surface of the second pipe 20 to prevent indentations. Since the first support member 51 is made of a water-soluble material, the first support member 51 may be easily eluted due to water supplied thereto.

The second support member 53 is in the form of particles or powder made of a water-insoluble inorganic material or metal material having a proper level of porosity (around 20%). Since materials constituting the second support member 53 do not have a property of sticking together, during a bending process, the materials receive a force applied to the outer portion of the pipe portion 30 and form an internal pressure, and simultaneously, transmit the received force to the surroundings so that density is even throughout the filling material 50. Therefore, it is possible to easily bend the pipe portion 30.

The second support member 53 does not react chemically with the first support member 51. For example, reaction or bonding in any form does not occur between the second support member 53 and the first support member 51 at a temperature of about 650° C. or lower.

The third support member 57 is air-permeable. This is to, in the case in which a melt is injected into the mold and the melting bar 55 partially melts, absorb the molten material and prevent the molten material from leaking to the outside. In the third support member 57, progressive erosion with the second pipe 20 does not occur.

The melting bar 55 is formed to pass through the entire pipe portion 30 in a longitudinal direction thereof and has a characteristic in that it changes to a liquid phase at a temperature of about 200° C. The melting bar 55 maintains its shape in a step in which the melt is injected into the mold to mold the molded product 40 and is removed by heating when the molding of the molded product 40 is completed.

In this case, a space that was occupied by the melting bar 55 remains as a hollow 53*a* inside the second support member 53. The hollow forms a flow path through which water may flow and serves to allow the second support member 53 to be easily removed by supply of water thereto.

Meanwhile, the melting bar 55 may partially melt in the step in which the melt is injected into the mold to mold the molded product 40, and in some cases, the melting bar 55 may fill a void formed inside the third support member 57. Therefore, in order to prevent a liquid-phase molten portion of the melting bar 55 from flowing to the outside, a volume of the melting bar 55 is formed to be smaller than the entire volume occupied by the void of the third support member 57.

The melting bar 55 should not react chemically with the second support member 53. For example, reaction or bonding in any form does not occur between the melting bar 55 and the second support member 53 at a temperature of about 650° C. or lower.

Meanwhile, in a method of manufacturing the core, that is, the pipe portion 30, according to the present invention, first, after allowing metallic bonding to occur between the first pipe 10 and the second pipe 20, the third support member 57 is filled in one end of both ends of the pipe portion 30.

Then, the first support member 51 is filled in the pipe portion 30, and the melting bar 55 is disposed to pass through a hollow of the first support member 51 in a longitudinal direction thereof.

Then, the second support member 53 is filled in the hollow of the first support member 51, and finally, the third support member 57 is filled in the other end of both ends of the pipe portion 30.

Meanwhile, a method of manufacturing a hollow product using a core according to the present invention includes a step in which the filling material 50 is filled in the core 30, that is, the pipe portion 30, a core input step in which the pipe portion 30 filled with the filling material 50 is input into a cavity of a mold that is openable and closeable, a molding step in which a melt is injected into the cavity to surround the pipe portion 30 so that the molded product 40 is molded, and a filling material 50 removing step in which the filling material 50 is removed from the core 30 embedded in the molded product 40.

The filling material 50 removing step will be described with reference to FIGS. 5 and 6. FIG. 5 is a cross-sectional view illustrating a state in which the third support member 57 and the melting bar 55 are removed from the pipe portion 30 having the support members 51, 53, and 57 filled therein that is illustrated in FIG. 3, and FIG. 6 is a cross-sectional view of the molded product 40 having the hollow formed therein, which is illustrated in FIG. 4, and illustrates a state in which the support members 51, 53, and 57 are removed from the hollow.

Referring to FIGS. 5 and 6, in the filling material 50 removing step, first, the third support member 57 closing both ends of the pipe portion 30 is removed. When the third support member 57 is removed, a hole 20*a*, that is, a first space portion 20*a*, is formed in a space that was occupied by the third support member 57.

Then, in the filling material 50 removing step, the molded product 40 illustrated in FIG. 4 is heated to melt the melting bar 55 so that a space portion, that is, a second space portion 53*a*, is formed inside the support member. A cross-sectional area of the second space portion 53*a* taken in a direction perpendicular to the longitudinal direction of the pipe portion 30 is smaller than a cross-sectional area of the first space portion 20*a* taken in the same direction.

Then, in the filling material 50 removing step, high-pressure water is supplied through any one of both ends of the pipe portion 30. The water supplied at a high pressure first enters the first space portion 20*a* and then strongly collides with cross-sections of the first support member 51 and the second support member 53. This is because the cross-sectional area of the second space portion 53*a* is smaller than the cross-sectional area of the first space portion 20*a*.

The water strongly colliding with the cross-sections of the first support member 51 and the second support member 53 enters the second space portion 53*a* and rapidly flows toward the other end of both ends of the pipe portion 30. Accordingly, the second support member 53 including a water-soluble material that is in contact with the second space portion 53*a* is rapidly dissolved.

Then, the first support member 51 may be easily removed as the supplied water strongly collides with one end of the first support member 51 and passes therethrough.

The present invention has been described above through limited embodiments and drawings, but the present invention is not limited thereto, and, of course, those of ordinary skill in the art to which the present invention pertains may make various modifications and changes within the technical idea of the present invention and the scope equivalent to the claims below.

DESCRIPTION OF SYMBOLS

4: mold
10: first pipe
20: second pipe
30: pipe portion
41: first mold
42: second mold
50: filling material

The invention claimed is:

1. A method of manufacturing a hollow product using a core, the method comprising:

a core input step in which a core filled with a filling material is input into a cavity of a mold that is openable and closeable;

a molding step in which a melt is injected into the cavity to surround the core so that a molded product is molded; and a filling material removing step in which the filling material is removed from the core embedded in the molded product, wherein the core includes a pipe having a hollow formed in the pipe, wherein the filling material includes:

a support member being configured to support the pipe; and a melting bar passing through the support member in a longitudinal direction of the melting bar, wherein the support member includes:

a first support member, being disposed inside the hollow of the pipe and having a space formed in the first support member;

a second support member, being disposed in the space; and a third support member, being disposed in the hollow of the pipe to close both ends of the pipe to prevent the first support member and the second support member from flowing to an outside, wherein the first support member is made of a water-soluble material, wherein the second support member is made of a water-insoluble material, wherein the third support member is made of an air-permeable material, wherein the melting bar passes through the second support member in a longitudinal direction of the second support member, wherein the filling material removing step includes:

removing the third support member so that a first space portion is formed in a space occupied by the third support member, and heating the molded product so that the melting bar melts and a second space portion is formed in the second support member, and wherein a melting point of the melting bar is about 200° C., and melting points of the first support member and the second support member are higher than the melting point of the melting bar.

2. The method according to claim 1, wherein a volume of the melting bar is formed to be smaller than an entire volume occupied by the third support member.

3. The method according to claim 1, wherein a cross-sectional area of the second space portion taken in a direction perpendicular to a longitudinal direction of the pipe is smaller than a cross-sectional area of the first space portion taken in a same direction.

4. The method according to claim 3, wherein the filling material removing step further includes supplying high-pressure water through one end of the both ends of the pipe to remove the first support member and the second support member, and wherein the supplied water enters the first space portion and collides with cross-sections of the first support member and the second support member, and the water colliding with the cross-sections of the first support member and the second support member enters the second space portion and flows toward an opposite end of the both ends of the pipe.

* * * * *